US006776685B2

(12) United States Patent
Reisher et al.

(10) Patent No.: US 6,776,685 B2
(45) Date of Patent: Aug. 17, 2004

(54) TOY VEHICLE RAMP

(75) Inventors: Dean C. Reisher, Brick, NJ (US); Gerhart P. Huy, Hamilton Square, NJ (US); Aritty J. Newton, Moorestown, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/145,185

(22) Filed: May 14, 2002

(65) Prior Publication Data

US 2003/0216102 A1 Nov. 20, 2003

(51) Int. Cl.[7] ..... A63H 18/02
(52) U.S. Cl. ..... 446/444
(58) Field of Search ..... 446/431, 465, 446/486, 429, 444; 104/53, 54

(56) References Cited

U.S. PATENT DOCUMENTS 3,590,524 A * 7/1971 Beny et al. ..... 446/429
3,858,875 A * 1/1975 Nemeth et al. ..... 273/460
4,291,878 A * 9/1981 Nagel et al. ..... 463/59
4,767,053 A 8/1988 Cook et al.
5,165,690 A 11/1992 Kelley, Jr.
5,203,733 A 4/1993 Patch et al.
6,093,079 A 7/2000 House
6,216,600 B1 4/2001 Verret

* cited by examiner

*Primary Examiner*—Jacob K. Ackun, Jr.
(74) *Attorney, Agent, or Firm*—Akin Gump Strauss Hauer & Feld, L.L.P.

(57) ABSTRACT

A toy vehicle ramp has a resiliently flexible sheet panel and a pair of stiffer support members. Each support member has a plurality of support points formed thereon arranged to define a channel in which a lateral edge portion of the sheet panel is slidingly received for height adjustment of the panel in the supports and thus of the ramp. One or more elastic members extend between the support members and beneath the sheet panel to hold the ramp together. The flexible sheet panel collapses and the band(s) stretch when a load heavier than an ordinary remote control toy vehicle is applied so that a child cannot jump from or ride over the ramp and so that the ramp can collapse without damage to its components for reassembly and reuse.

7 Claims, 2 Drawing Sheets

FIG. 3
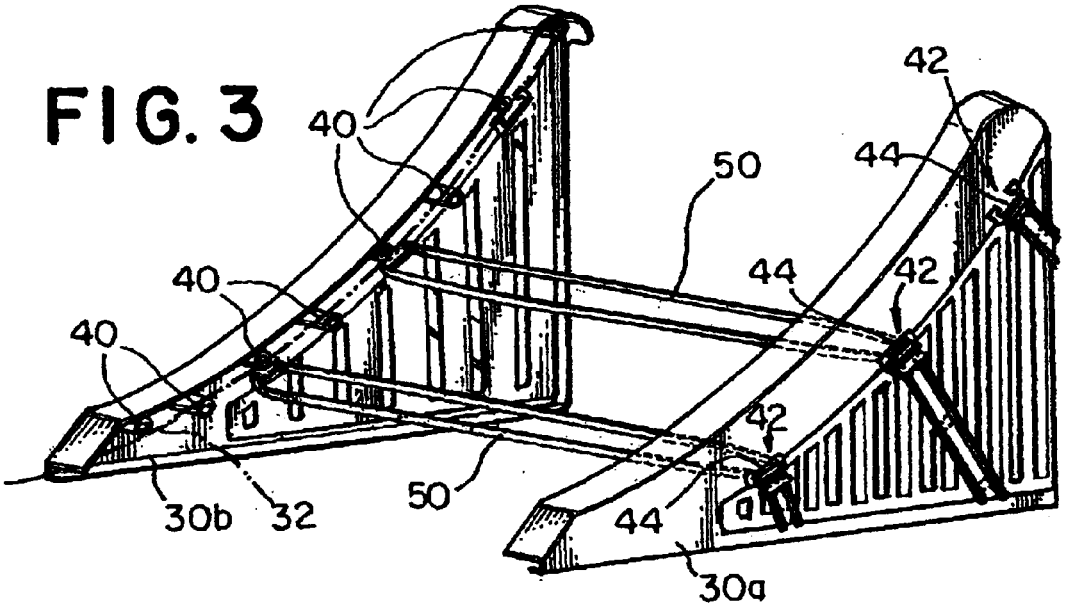
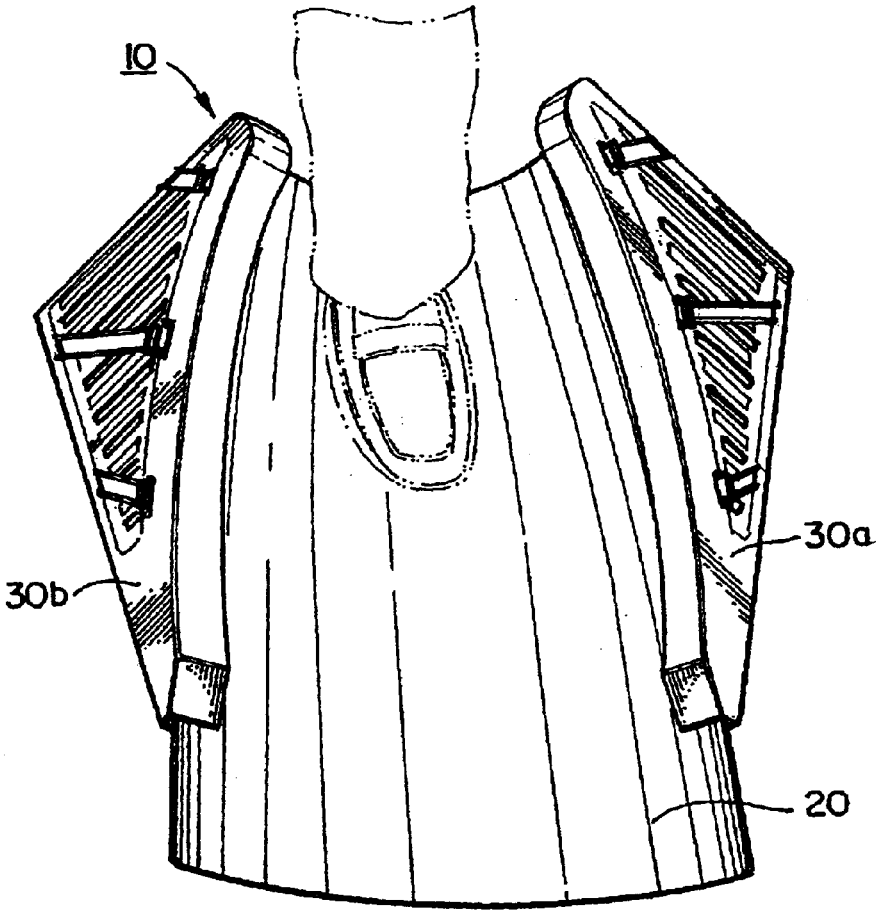
FIG. 4

TOY VEHICLE RAMP

BACKGROUND OF THE INVENTION

The present invention relates generally to toy ramps and, more particularly, to toy vehicle stunt ramps that allow toy vehicles to jump therefrom.

Toy vehicles such as remote controlled cars, trucks and the like are extremely popular with children as well as adults. Various ramps for such vehicles are known including ramps which form part of a racetrack, ramps having loops and pivotable ramps. However, none of the prior art ramps provide a simple, durable, inexpensive and adjustable toy ramp which is easily assembled by a child for use with a variety toy vehicles.

BRIEF SUMMARY OF THE INVENTION

According to one aspect of the invention, a toy vehicle ramp is provided comprising a flexible sheet panel having a first and second side edge portions and a plurality of support members each having a plurality of support points formed thereon. The support points are arranged on each support member to define a channel for slideably engaging one of the first and second side edge portions of the sheet panel.

According to a further aspect of the invention a toy vehicle ramp is provided comprising a flexible sheet panel forming a jumping surface, a first support member having a channel defined on an inner surface thereof, and a second support member having a channel defined on an inner surface thereof. The channel on the first support member and the channel on the second support member respectively slideably engage a first side edge portion and a second side edge portion of the sheet panel.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the Drawings:

FIG. 3 is a perspective view of FIG. 1 with the flexible sheet panel removed to reveal the support members having elastic bands extending therebetween; and FIG. 4 is a front perspective view of the embodiment of FIG. 1 showing the ramp in a collapsed position.

DETAILED DESCRIPTION OF THE INVENTION

Figure 1:
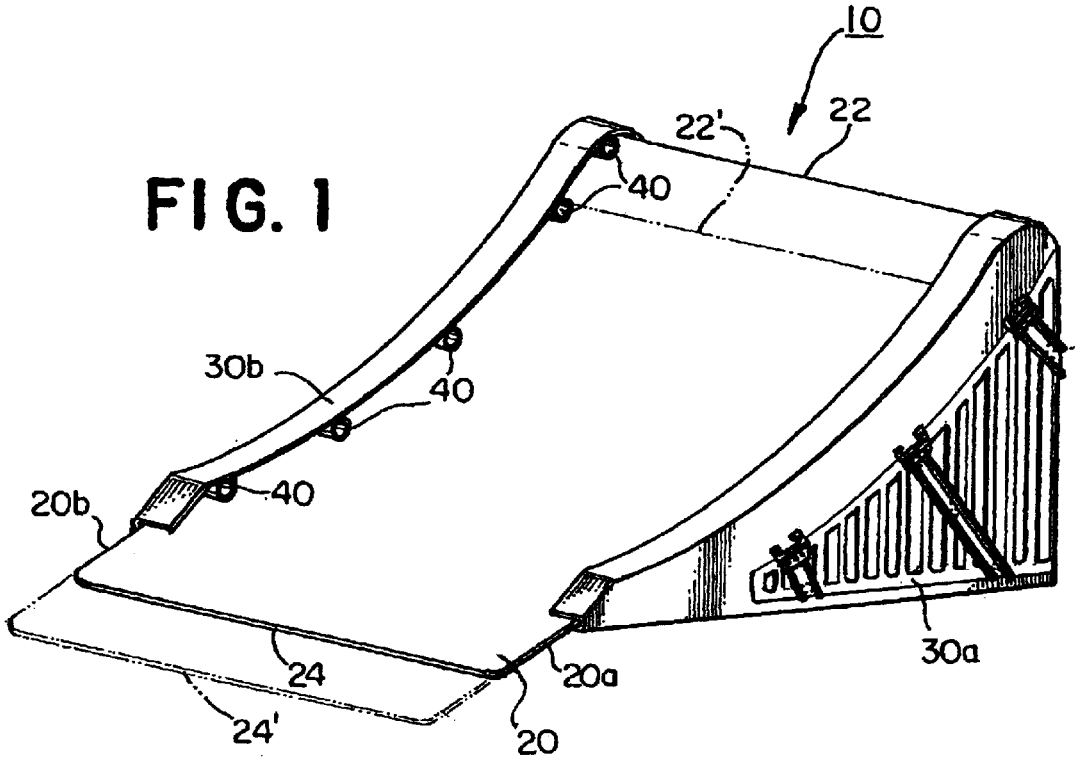
FIG. 1 is a perspective view of a toy vehicle ramp of the present invention.
Figure 2:
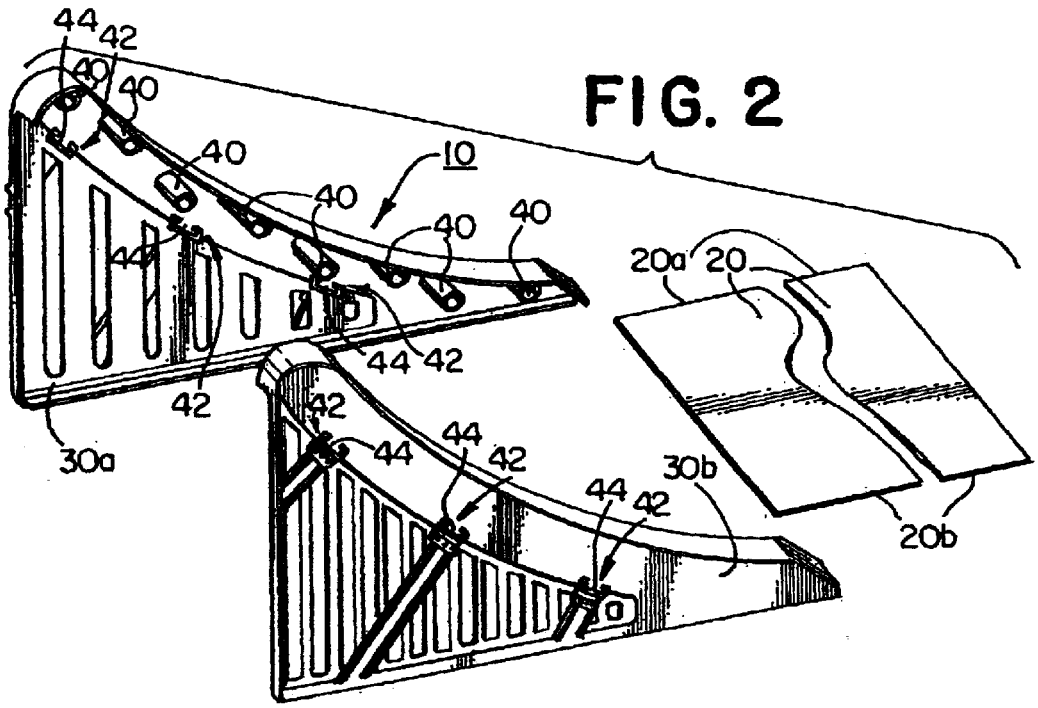
FIG. 2 is an exploded view of the ramp of FIG. 1 showing the flexible sheet panel and the support members.

Referring to the drawings and particularly to FIG. 1, a preferred embodiment of the toy vehicle ramp 10 of the present invention is disclosed. A resiliently flexible sheet panel 20 is provided as the jumping surface for the ramp 10. Two support members 30*a*, 30*b* are shown. Each support member 30*a*, 30*b* has a plurality of support points 40 which, in the preferred embodiment, are in the form of tubular stems extending from the support members 30*a*, 30*b* (stems 40 of support member 30*a* shown in FIG. 2). The support points 40 are preferably positioned (e.g. staggered) along an inner surface of the support members 30*a*, 30*b* such that the support points 40 effectively define a channel configured to receive therein and slidingly contact a lateral side edge of the sheet panel 20.

The sheet panel 20 is preferably a flat, thin sheet made out of resiliently flexible material, such as polypropylene plastic or the like, so that the sheet panel 20 can be bent to provide a curved ramp surface when inserted in the channels defined in the support members 30*a*, 30*b* and can non-destructively collapse and rebound under relatively modest load for safety.

The support members 30*a*, 30*b* are preferably generally triangular in shape and are preferably made of a more resilient/less flexible molded plastic material than the material of the sheet panel 20 such as ABS (acrylonitrile butadiene styrene). It will be understood that the support members 30*a*, 30*b* can be made of various materials and can be formed in a variety of shapes to provide support for the sheet panel 20. Although the preferred embodiment shown in the figures includes two support members 30*a*, 30*b*, each of the support members 30*a*, 30*b* may be formed as one or more separate or integral parts.

The support points 40, although shown in the preferred embodiment as tubular stems, may alternatively comprise tabs, slotted projections, studs, shaped surfaces or the like, positioned to form a channel for receiving the sheet panel 20 and indicated, for example, by broken line 32 in FIG. 3. Further, the channel for receiving the sheet panel 20 may be formed on any surface of the support members 30*a*, 30*b* above their bottom surfaces. For example, the channel alternately could be defined by a curvilinear slot with continuously opposing side edges or with spaced and/or staggered lengths of side edges to define such slot, with or without undulations or one or more protrusions transverse to the length of the slot designed to generate a frictional force on one or both major sides of the sheet panel within the channel to prevent overly easy sliding movement of the sheet panel along each channel.

One or more elastic members such as elastic bands 50 shown in FIG. 3, are provided to connect the support members 30*a*, 30*b*. The elastic band(s) 50 extend between the support members 30*a*, 30*b*, and extend beneath the sheet panel 20 when the sheet panel 20 is inserted in the channels of the support members 30*a*, 30*b*. The elastic band(s) 50 provide support for the sheet panel 20 and provide an inward force on the support members 30*a*, 30*b*. The inward force on the support members 30*a*, 30*b* holds the support members 30*a*, 30*b* against the side edge portions 20*a*, 20*b* of the sheet panel 20. Appropriate slots 42 are provided to define studs 44 in the plane of the support members 30*a*, 30*b* around which each band 50 is looped. In the depicted embodiment, two identical bands are used, extended between the lower two pairs of studs 44. It is suggested that the elastic members 50 be located at the lower end of the ramp to best absorb the impact and direction changing forces applied to the ramp by the toy vehicle(s) using the ramp.

As shown in FIG. 1, when the sheet panel is inserted into the support members 30*a*, 30*b*, the sheet panel 20 is slidingly engaged by the support points 40 of the support members 30*a*, 30*b*. Side edge portions 20*a*, 20*b* of the sheet panel 20 are engaged within the channels defined by the support points 40 on the support members 30*a*, 30*b*. The height of the ramp 10 may be adjusted by adjusting how far the sheet panel 20 is inserted into the support members 30*a*, 30*b*. The upper and lower edges 22, 24, respectively of the side panel 20 are shown in solid in FIG. 1 in the most elevated position of the sheet panel, while a possible lower position of those edges are indicated by broken lines 22', 24'. The ease of movement of the sheet panel 20 along the channels is controlled by the tension of the elastic band(s) 50. Alternatively or in addition, ease of movement of the sheet panel along the channels could be controlled by increasing the contact area(s) between the support points or other structure (s) defining the channels and the edge surfaces of the panel 20 contacting those structures or the degree the edge portions need to deflect back and forth to weave their way through the supports.

The ramp 10 is preferably designed to be used for a variety of toy vehicles. The ramp 10 is also preferably designed to be collapsible. The collapsible feature is provided to prevent injury to users attempting to jump off of the ramp 10 on, for example, a skateboard, bicycle, or the like, and to prevent damage to the ramp 10 in the event that it is stepped on or otherwise forced to collapse. As shown in FIG. 4, the sheet panel 20, the support members 30*a*, 30*b*, and the elastic band(s) 50 are designed to coact to allow the ramp 10 to collapse when anything heavier than a relatively light pre-determined weight is placed on the ramp 10. The predetermined weight is, for example , a weight greater than an ordinary R/C vehicle or other unridden toy vehicle which could fit on the ramp, but less than the weight of a toddler or young child, that might try to walk or ride on a toy directly or partially over the ramp. With two supplied elastic bands 50, and an approximately eighty thousandths (0.080 or 5/64) inch thick sheet of polypropylene, the depicted ramp 10 is configured to support a weight of at least five pounds and to begin to collapse under a static weight of less than ten pounds, preferably somewhere in a range of about six to about eight pounds and to fully collapse to the position depicted in FIG. 4 at a weight of about twenty pounds or less. It will also be appreciated that in a collapse, the sheet panel can pull out of either or both support members. The construction permits collapse to occur without damage to the components and with an easy reassembly of the ramp.

It will be appreciated by those skilled in the art that changes could be made to the embodiments described above without departing from the broad inventive concept thereof. For example, it will be appreciated that other types of elastic members such as tension coil springs, elastic tubing and others might be substituted for conventional elastic bands 50 to resiliently yet releasably hold the support members together on either side of the sheet panel 20. Also, one heavier stronger elastic band could be stretched between two pairs of studs on the support members. It is understood, therefore, that this invention is not limited to the particular embodiments disclosed, but it is intended to cover modifications within the spirit and scope of the present invention as defined by the appended claims.

We claim:

1. A toy vehicle ramp comprising;

a flexible sheet panel having a first and second side edge portions; and a plurality of support members each having a plurality of support points formed thereon and arranged on each support member to define a channel for slideably engaging one of the first and second side edge portions of the sheet panel;

wherein the support points comprise a plurality of tubular stems extending from the support members.

2. A toy vehicle ramp comprising:

a flexible sheet panel having a first and second side edge portions;

a plurality of support members each having a plurality of support points formed thereon and arranged on each support member to define a channel for slideably engaging one of the first and second side edge portions of the sheet panel; and at least one elastic member extending between the support members and beneath the sheet panel to hold the support members together.

3. The toy vehicle ramp according to claim 2, wherein the sheet panel, the support members and the at least one elastic member coact to support a weight of at least about five pounds and no more about twenty pounds.

4. A toy vehicle ramp comprising:

a flexible sheet panel forming a jumping surface;

a first support member having a channel defined on an inner surface thereof;

a second support member having a channel defined on an inner surface thereof; and at least one elastic member extending between the first and second support members and beneath the sheet panel;

wherein the channel on the first support member and the channel on the second support member respectively slideably engage a first side edge portion and a second side edge portion of the sheet panel.

5. The toy vehicle ramp according to claim 4, wherein the flexible sheet panel, the support members and the at least one elastic member coact to support a weight of at least about five pounds and no more than about twenty pounds.

6. A toy vehicle ramp comprising:

a flexible sheet panel forming a jumping surface;

a first support member having a channel defined on an inner surface thereof;

a second support member having a channel defined on an inner surface thereof; and at least one elastic member extending between first and second support members and beneath the sheet panel so as to hold the support member together on opposite lateral sides of the flexible sheet panel; and wherein the height of the ramp is adjustable by adjusting the position of the sheet panel along the channels on the first and second support members; and wherein the channel on the first support member and the channel on the second support member respectively slideably engage a first side edge portion and a second side edge portion of the sheet panel.

7. The toy vehicle ramp according claim 6, wherein the channels defined on the support members comprise a plurality of protrusions extending from the support members.

* * * * *